US010325430B2

(12) United States Patent
Eid

(10) Patent No.: US 10,325,430 B2
(45) Date of Patent: Jun. 18, 2019

(54) METHODS AND SYSTEMS FOR OPERATING DOOR LOCKS USING MOBILE DEVICES

(71) Applicant: Gilbert Eid, Kahhaleh (LB)

(72) Inventor: Gilbert Eid, Kahhaleh (LB)

( * ) Notice: Subject to any disclaimer, the term of this patent is extended or adjusted under 35 U.S.C. 154(b) by 1 day.

(21) Appl. No.: 15/343,239

(22) Filed: Nov. 4, 2016

(65) Prior Publication Data

US 2018/0130273 A1 May 10, 2018

(51) Int. Cl.
*G07C 9/00* (2006.01)

(52) U.S. Cl.
CPC ..... *G07C 9/00309* (2013.01); *G07C 9/00571* (2013.01); *G07C 2009/00412* (2013.01); *G07C 2009/00769* (2013.01)

(58) Field of Classification Search
CPC ..... G07C 9/00309; G07C 9/00571; G07C 2009/00325; G07C 2009/00333; G07C 2009/00412; G07C 2009/0042; G07C 2009/00436; G07C 2009/00452; G07C 2009/00476
USPC ..... 340/5.6, 5.61
See application file for complete search history.

(56) References Cited

U.S. PATENT DOCUMENTS 6,904,526 B1 * 6/2005 Hongwei ..... G06F 21/31 713/172
2004/0086117 A1 * 5/2004 Petersen ..... H04L 9/001 380/44
2014/0082376 A1 * 3/2014 Roden ..... H04L 67/1097 713/193
2015/0170448 A1 * 6/2015 Robfogel ..... G07C 9/00904 340/5.61
2015/0310685 A1 * 10/2015 Bliding ..... G07C 9/00103 340/5.61
2016/0191494 A1 * 6/2016 Claes ..... H04L 63/0853 713/159

* cited by examiner

*Primary Examiner* — Steven Lim
*Assistant Examiner* — Mancil Littlejohn, Jr.
(74) *Attorney, Agent, or Firm* — Georgiy L. Khayet

(57) ABSTRACT

A lock stores two keys and can wirelessly communicate with a mobile device. After the mobile device obtains a lock instruction from a user, the lock generates a dynamic variable, encrypts it with a first key, and produces a first encrypted message including the encrypted dynamic variable. The first encrypted message is transmitted to the mobile device, which forwards it to a server. The server decrypts the first encrypted message with the first key, retrieves the dynamic variable, and encrypts the dynamic variable with a second key. The server produces a second encrypted message with the encrypted dynamic variable and sends the same to the mobile device, which forwards it to the lock. The lock decrypts the second encrypted message with the second key and determines that the decrypted dynamic variable is the same as was produced by the lock earlier. Based on the determination, the lock locks/unlocks a door.

18 Claims, 5 Drawing Sheets

METHODS AND SYSTEMS FOR OPERATING DOOR LOCKS USING MOBILE DEVICES

BACKGROUND

Technical Field

This disclosure generally relates to electronic access control devices that can be locked or unlocked remotely. More particularly, this disclosure relates to systems and methods for operating door locks using mobile devices.

Description of Related Art

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

Traditional door locks serve preventing unauthorized entrance to building or premises. The traditional locks are operated with keys such as conventional metal keys that are to be inserted within a keyhole to lift tumblers and allow the key to rotate within the lock to disengage a locking device. Other locks include keypads that require a manual entry of a code in order to disengage the locking device.

Electronic door locks recently became popular. In recent years, many of the electric lock on the market are "smart connected locks" which can be operated by communicating with a website or server that can remotely instruct the locks to lock or unlock upon receipt of a user command. For these ends, the electronic door locks are to be operatively connected to the Internet via a wireless local area network or other data networks. In practice, however, establishing data communication between the electronic door locks and servers are not always feasible. For example, a Wi-Fi network may fail to operate preventing the electronic door locks to connect to the server and perform locking or unlocking operation when needed. Thus, the electronic door locks may be vulnerable in view of the need of their connection to the wireless local area network.

The advantage of the locks connected to certain servers is to allow an administrator of a particular lock to dynamically allocate and revoke access rights for different individuals. The challenge, however, is to provide a device that could be added to a circuit of any regular and conventional electric door lock in order to make it a smart lock without the need to connect it to the Internet. The challenge is that this device needs to be able to communicate quickly and securely with mobile phones and execute specific instructions without the need of establishing a wireless connection between the device and the mobile phone. Yet additional challenge is that the administrator of the lock needs to still be able to dynamically allow and revoke access rights to users even though the device controlling the lock is not connected to the internet.

SUMMARY

This section is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

In one aspect of this disclosure, there is provided a method for operating a lock. The method comprises: wirelessly communicating, by a mobile device, with a lock when the mobile device of a user is within a predetermined distance from the lock; receiving, by the mobile device, a first encrypted message from the lock; sending, by the mobile device, the first encrypted message supplemented with user credential data and a lock instruction to a server; receiving, by the mobile device, a second encrypted message from the server after sending the first encrypted message to the server; wirelessly transmitting, by the mobile device, the second encrypted message to the lock to cause the lock to perform a locking operation or an unlocking operation based on the lock instruction of the user.

In another aspect of this disclosure, there is provided a lock for locking and unlocking a door. The lock comprises an electromechanical locking module, a communication module configured to wirelessly communicate with a mobile device when the mobile device is within a predetermined distance from the lock, a memory storing a first key and a second key, wherein the mobile device does not store the first key nor the second key, and a processor. The processor is configured to: generate a first dynamic variable; generate a first encrypted message based on the first dynamic variable and the first key; emit the first encrypted message; receive a second encrypted message from the mobile device after sending the first encrypted message; decrypt the second encrypted message using the second key to retrieve a second dynamic variable; verify that the second dynamic variable retrieved from the second encrypted message is an acceptable dynamic variable; and, based on verification, cause the electromechanical locking module to perform a locking operation or an unlocking operation.

In yet another aspect of this disclosure, there is provided a system for operating a door lock. The system comprises a server and a lock. The lock comprises: an electromechanical locking module; a communication module configured to wirelessly communicate with a mobile device when the mobile device is within a predetermined distance from the lock; a memory storing a first key and a second key, wherein the mobile device does not store the first key nor the second key; and a processor. The processor is configured to: generate a first dynamic variable; generate a first encrypted message based on the first dynamic variable and the first key; emit the first encrypted message; receive a second encrypted message from the mobile device after sending the first encrypted message; decrypt the second encrypted message using the second key to retrieve a second dynamic variable; verify that the second dynamic variable retrieved from the second encrypted message is an acceptable dynamic variable; and, based on verification, cause the electromechanical locking module to perform a locking operation or an unlocking operation. The server is configured to: receive the first encrypted message from the mobile device; decrypt the first encrypted message with the first key to extract the first dynamic variable; encrypt the first dynamic variable with the second key; generate the second encrypted message that includes the second dynamic variable encrypted with the second key, wherein the first dynamic variable matches the second dynamic variable; and send the second encrypted message to the mobile device in response to receiving the first encrypted message.

Additional objects, advantages, and novel features of the examples will be set forth in part in the description, which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

Embodiments are illustrated by way of example and not limitation in the figures of the accompanying drawings, in which like references indicate similar elements and in which.

DETAILED DESCRIPTION OF EXAMPLE EMBODIMENTS

Figure 1:
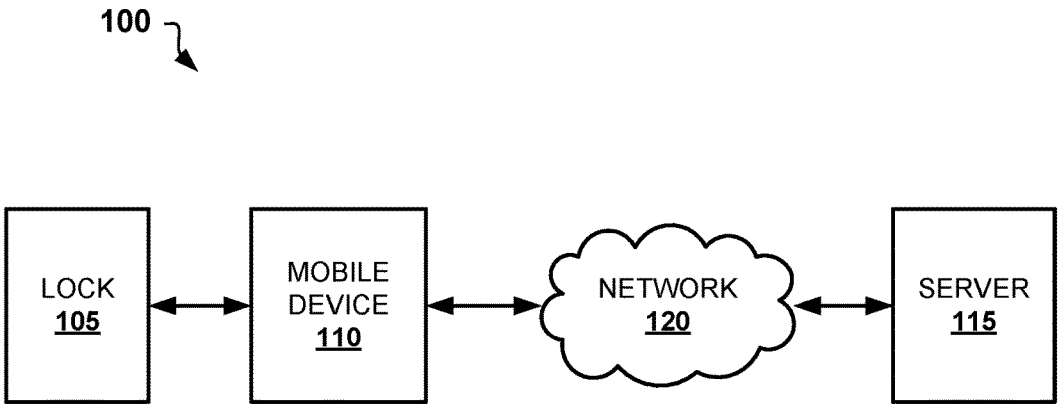
FIG. 1 shows a block diagram of an example system for operating a door lock according to one example embodiment.

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

Aspects of the embodiments will now be presented with reference to a system and method for operating a lock. These system and method will be described in the following detailed description and illustrated in the accompanying drawings by various blocks, components, circuits, steps, operations, processes, algorithms, and so forth (collectively referred to as "elements"). These elements may be implemented using electronic hardware, computer software, or any combination thereof. Whether such elements are implemented as hardware or software depends upon the particular application and design constraints imposed on the overall system.

By way of example, an element, or any portion of an element, or any combination of elements may be implemented with a "processing system" that includes one or more processors. Examples of processors include microprocessors, microcontrollers, Central Processing Units (CPUs), digital signal processors (DSPs), field programmable gate arrays (FPGAs), programmable logic devices (PLDs), state machines, gated logic, discrete hardware circuits, and other suitable hardware configured to perform various functions described throughout this disclosure. One or more processors in the processing system may execute software, firmware, or middleware (collectively referred to as "software"). The term "software" shall be construed broadly to mean instructions, instruction sets, code, code segments, program code, programs, subprograms, software components, applications, software applications, software packages, routines, subroutines, objects, executables, threads of execution, procedures, functions, etc., whether referred to as software, firmware, middleware, microcode, hardware description language, or otherwise.

Accordingly, in one or more exemplary embodiments, the functions described may be implemented in hardware, software, or any combination thereof. If implemented in software, the functions may be stored on or encoded as one or more instructions or code on a non-transitory computer-readable medium. Computer-readable media includes computer storage media. Storage media may be any available media that can be accessed by a computer. By way of example, and not limitation, such computer-readable media can comprise a random-access memory (RAM), a read-only memory (ROM), an electrically erasable programmable ROM (EEPROM), compact disk ROM (CD-ROM) or other optical disk storage, magnetic disk storage, solid state memory, or any other data storage devices, combinations of the aforementioned types of computer-readable media, or any other medium that can be used to store computer executable code in the form of instructions or data structures that can be accessed by a computer.

For purposes of this patent document, the terms "or" and "and" shall mean "and/or" unless stated otherwise or clearly intended otherwise by the context of their use. The term "a" shall mean "one or more" unless stated otherwise or where the use of "one or more" is clearly inappropriate. The terms "comprise," "comprising," "include," and "including" are interchangeable and not intended to be limiting. For example, the term "including" shall be interpreted to mean "including, but not limited to."

It should be also understood that the terms "first," "second," "third," and so forth can be used herein to describe various elements. These terms are used to distinguish one element from another, but not to imply a required sequence of elements. For example, a first element can be termed a second element, and, similarly, a second element can be termed a first element, without departing from the scope of present teachings.

The term "mobile device" shall be construed to mean a portable electronic device having wireless communication functionality and telephone functionality, including a radiotelephone, mobile station, cellular phone, mobile phone, smart phone, user equipment, personal digital assistant, tablet computer, laptop computer, among others.

The term "lock" shall be construed to mean an electronic lock having an electromechanical locking module for locking and unlocking a door or similar device. In this disclosure, the terms "lock" and "door lock" can be used interchangeably. The term "lock" can also refer to an electrical circuit configured to perform an opening (or turning on) and closing (or turning off) operations. Thus, the lock can also refer to a smart electrical switch configured to turn on or turn off a vehicle engine, a desk lamp, or any other equipment or appliance.

Referring now to the drawings, exemplary embodiments are described. The drawings are schematic illustrations of idealized example embodiments. Thus, the example embodiments discussed herein should not be construed as limited to the particular illustrations presented herein, rather these example embodiments can include deviations and differ from the illustrations presented herein.

FIG. 1 shows a block diagram of an example system 100 for operating a lock 105 according to one example embodiment. System 100 includes at least one lock 105 for locking and unlocking a door or similar arrangement. Lock 105 can also relate to an electrical circuit configured to turn on or off another electrical device. Thus, lock 105 can also refer to an electrical switch (relay) configured to turn on or turn off or any other electrical equipment, appliance, or computing devices.

Lock 105 can wirelessly communicate with at least one mobile device 110 using Near Field Communication (NFC) protocols, Bluetooth Protocols (e.g., BLE protocol), and the like. Mobile device 110 can be operatively connected to a server 115, such as a remote web server, via at least one data network 120. Network 102 can refer to any wired, wireless, or optical networks including, for example, the Internet, cellular phone networks, IEEE 802.11-based radio frequency network, Internet Protocol (IP) communications network, or any other data communication network utilizing physical layers, link layer capability, or network layer to carry data packets, or any combinations of the above-listed data networks. In certain implementations, lock 105 is not configured to communicate with server 115. Moreover, in certain implementations, lock 105 can be configured to wirelessly communicate with mobile device 110 only. Thus, lock 105 may not communicate with a modem (e.g., a cable modem, network router, wireless hot spot, etc.) to have access to the internet or server 115.

Lock 105 can emit predetermined signals, which can be acquired by mobile device 110 with a dedicated mobile application configured to scan, receive and process the signals emitted by lock 105. In other words, mobile device 110 is operated by a user who comes in a predetermined proximity to lock 105 such that lock 105 can start wirelessly communicating with mobile device 110. Mobile device 110 may have a mobile application installed to provide a graphical user interface enabling the user to instruct lock 105 to perform a locking operation or unlocking operation. Mobile device 110 may include or store user credential data, such as user identifier, also known to server 115.

Figure 2:
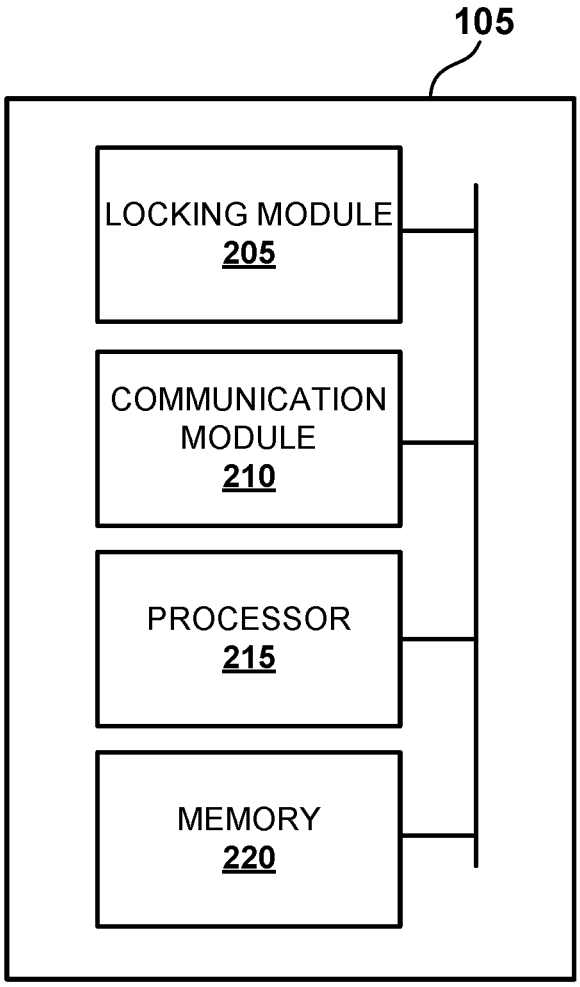
FIG. 2 shows a block diagram of lock according to one example embodiment.

FIG. 2 shows a block diagram of lock 105 according to one example embodiment. Lock 105 includes a locking module 205 such as an electric or electromechanical locking mechanism configured to lock or unlock a door or similar device. Lock 105 also includes a communication module 210 configured to establish wireless communication with mobile device 110 as described above. Lock 105 also includes processor 215 (e.g., microprocessor, microcontroller or any other data processing device having a clock) for controlling the operation of locking module 205 and communication module 210, and for data processing as described herein. Lock 105 also includes memory 220 for storing processor-readable instructions that can be implemented by processor 215. Memory 220 can also store two keys such as digital encryption-decryption keys, cryptographic keys, private keys, and the like. In some implementations, each of two keys is of 256-bit length, although other lengths are also possible. The keys (i.e., a first key and a second key) stored in memory are not available to mobile device 110 and are not known to mobile device 110. Server 115, however, stores the same keys as memory 220 of lock 105. The keys can be uniquely selected for each individual user. Thus, in some implementations, the keys can be associated with user credentials or user identifiers. In addition, the first key differs from the second key.

In operation, when the user provides a lock instruction (i.e., to lock a door or unlock the door) through the graphical user interface of mobile device 110, mobile device 110 may establish wireless communication with lock 105. For example, mobile device 110 may transmit the lock instruction or another message to lock 105 to cause its operation. In response, processor 215 generates a dynamic variable using a clock of lock 105 or any suitable deterministic algorithm. For example, the dynamic variable is a value generated based on current time. In another example, the dynamic variable can be a hash value of current time. In another example, the dynamic variable can be a randomly selected value of predetermined parameters. Further, processor 215 encrypts the dynamic variable using the first key stored in memory 220. Processor 215 also produces a first encrypted message to include the dynamic variable encrypted with the first key. Processor 215 can also store the dynamic variable in memory 220.

In some implementations, the dynamic variable is a constant value. In other implementations, however, the dynamic variable can be repeatedly changing based on an algorithm (e.g., a deterministic algorithm) known both to lock 105 and server 115. Dynamic variables can have non-repetitive values.

Figure 3:
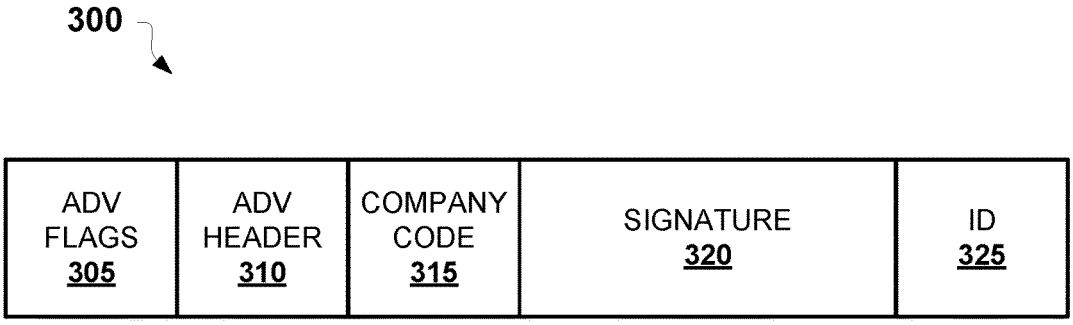
FIG. 3 shows a block diagram of an example of an emitted signal according to one example embodiment.

FIG. 3 shows a block diagram of example encrypted message 300 emitted by a lock according to an example embodiment. Encrypted message 300 can be an instance of the first encrypted message created by lock 105. As shown in FIG. 3, encrypted message 300 includes advertising flags 305, an advertising header 310, a company code 315, a signature 320, and an identifier 325. Encrypted message 300 can be a data packet. Signature 320 bears an encrypted dynamic variable. Thus, in some implementations, signature 320 is the dynamic variable produced by processor 215 and encrypted by processor 215 using the first key stored in memory 220. In other implementations, signature 320 includes an aggregation of a series of variables, where at least one of the variables is the dynamic variable. In some additional implementations, the dynamic variable can reputedly or constantly change according to an algorithm shared between lock 105 and server 115 only (and not mobile device 110). Identifier 325 of FIG. 3 refers to an identifier of lock 105.

Referring now to FIG. 1 and FIG. 2, after processor 215 produces the first encrypted message, communication module 210 wirelessly transmits the first encrypted message to mobile device 110. When mobile device 110 receives the first encrypted message, mobile device 110 supplements it with the user credential data and the lock instruction earlier obtained from the user. For example, mobile device 110 can supplement the first encrypted message with a user identifier and user instruction (e.g., an instruction to open or close lock 105). Mobile device 110 does not decrypt the first encrypted message. Instead, mobile device 110 sends the first encrypted message supplemented with the user credential data and the lock instruction to server 115.

After server 115 receives the first encrypted message supplemented with the user credential data and the lock instruction, server 115 retrieves the first key and the second key associated with the user credential data from server memory. Server 115 further decrypts the first encrypted message (or its signature) using the first key to retrieve the dynamic variable. Sever 115 can also verify that the retrieved dynamic variable is coherent with the algorithm of lock 105 used to generate the dynamic variable. If the retrieved dynamic variable is verified and coherent, server 115 can verify the user credential data. If the user credential data are successfully verified with a clearance required to execute the locking or unlocking operation, server 115 encrypts the dynamic value with the second key. Further, server 115 creates a second encrypted message, which can have same structure as encrypted message 300 of FIG. 3.

Thus, in some implementations, the second encrypted message differs from the first encrypted message in only signature 320. Particularly, signature 320 of the first encrypted message is the dynamic value encrypted with the first key, while signature 320 of the second encrypted message is the same dynamic value but encrypted with the second key. In other implementations, however, the second encrypted message can have flags 305 and header 310 other than those in the first encrypted message. Server 115 further sends the second encrypted message to mobile device 110.

After mobile device 110 receives the second encrypted message, mobile device 110 forwards the second encrypted message (without decrypting it) to lock 105. After lock 105 receives the second encrypted message, lock 105 decrypts the second encrypted message (or its signature 320) with the second key to retrieve the dynamic variable. When the dynamic variable is retrieved from the second encrypted message, lock 105 verifies that this dynamic variable is compatible and coherent with the algorithm that was used to create the dynamic variable earlier. In some implementations, however, lock 105 determine that the dynamic variable retrieved from the second encrypted message is exactly the same as was generated by lock 105 before and optionally stored in memory 220. In other implementations, however, lock 105 can verify that the dynamic variable retrieved from the second encrypted message is coherent with the algorithm (e.g., a deterministic algorithm) used to generate dynamic variables.

After the above-described successful determination or verification procedure, processor 215 causes locking module 205 to perform a locking operation or an unlocking operation based on the lock instruction earlier obtained from the user. In addition, if lock 105 previously stored the dynamic variable in memory 220, lock 105 can delete or remove the dynamic variable.

In the following operation of lock 105, lock 105 considers all previously generated dynamic variables to produce new dynamic variables. The new dynamic variables are produced by lock 105 such that no dynamic variable matches to previously used dynamic variables. In other words, the dynamic variables repeatedly change such that there is no single dynamic variable that can be used twice for encrypting and generated encrypted messages. This ensures high reliability and security of lock 105.

Figure 4:
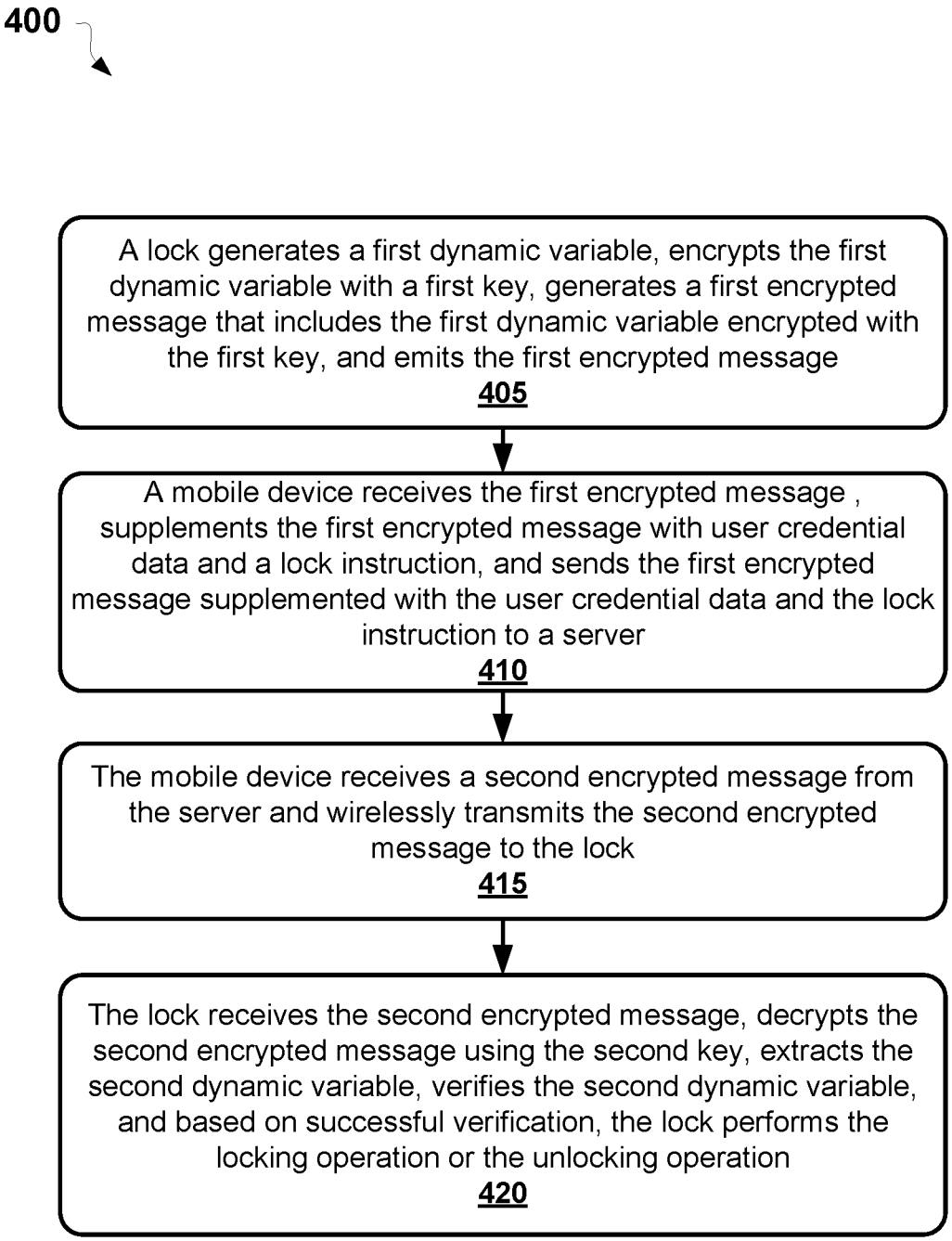
FIG. 4 is a process flow diagram showing a method for operating a lock according to an example embodiment.

FIG. 4 is a process flow diagram showing a method 400 for operating lock 105 according to an example embodiment. Method 400 may be performed by processing logic that may comprise hardware (e.g., decision-making logic, dedicated logic, programmable logic, application-specific integrated circuit (ASIC), and microcode), software (such as software run on a general-purpose computer system or a dedicated machine), or a combination of both. In one example embodiment, the processing logic refers to lock 105, mobile device 110, and server 115. Notably, below recited steps of method 400 may be implemented in an order different than described and shown in the figure. Moreover, method 400 may have additional steps not shown herein, but which can be evident for those skilled in the art from the present disclosure. Method 400 may also have fewer steps than outlined below and shown in FIG. 4.

Method 400 commences at operation 405 when lock 105 constantly generates a first dynamic variable according to a deterministic algorithm, encrypts the first dynamic variable with a first key, generates a first encrypted message that includes the first dynamic variable encrypted with the first key, and emits the first encrypted message (such that it is later received by mobile device 110). The first encrypted message includes at least a header, a first signature, and an identifier of lock 105. The first signature includes the first dynamic variable encrypted with the first key.

At operation 410, mobile device 110 receives the first encrypted message from lock 105, supplements the first encrypted message with user credential data and a lock instruction (e.g., an instruction to open lock 105 or close lock 105), and sends the first encrypted message supplemented with the user credential data and the lock instruction to server 115.

At operation 415, after sending the first encrypted message to server 115, mobile device 110 receives a second encrypted message from server 115. To generate the second encrypted message, sever 115 decrypts the first encrypted message with the first key to extract the first dynamic variable, optionally verifies the first dynamic variable (e.g., by checking it is coherent with a predetermined algorithm used to produce the first dynamic variable in accord with the user credential data), encrypts the first dynamic variable with the second key, and generates the second encrypted message that includes a second dynamic variable encrypted with the second key (where the first dynamic variable is the same as the second dynamic variable). Accordingly, the second encrypted message includes at least the header, a second signature, and the identifier of lock 105. The second signature includes the second dynamic variable encrypted with the second key. Further, at the same operation 415, mobile device 110 wirelessly transmits the second encrypted message to lock 105 to cause the lock to perform a locking operation or an unlocking operation based on the lock instruction of the user.

At operation 420, lock 105 receives the second encrypted message from mobile device 105 (for these ends, lock 105 can constantly scan for signals emitted by other devices that have the same identifiers as the identifier of lock 105), decrypts the second encrypted message using the second key, extracts the second dynamic variable, verifies the second dynamic variable, and based on successful verification, lock 105 performs the locking operation or the unlocking operation. The verification of the second dynamic variable can include matching the second dynamic variable to the first dynamic variable. Alternatively, the verification of the second dynamic variable can include verifying that the second dynamic variable is compatible and coherent with the algorithm (e.g., deterministic algorithm) used to produce the first dynamic variable.

Figure 5:
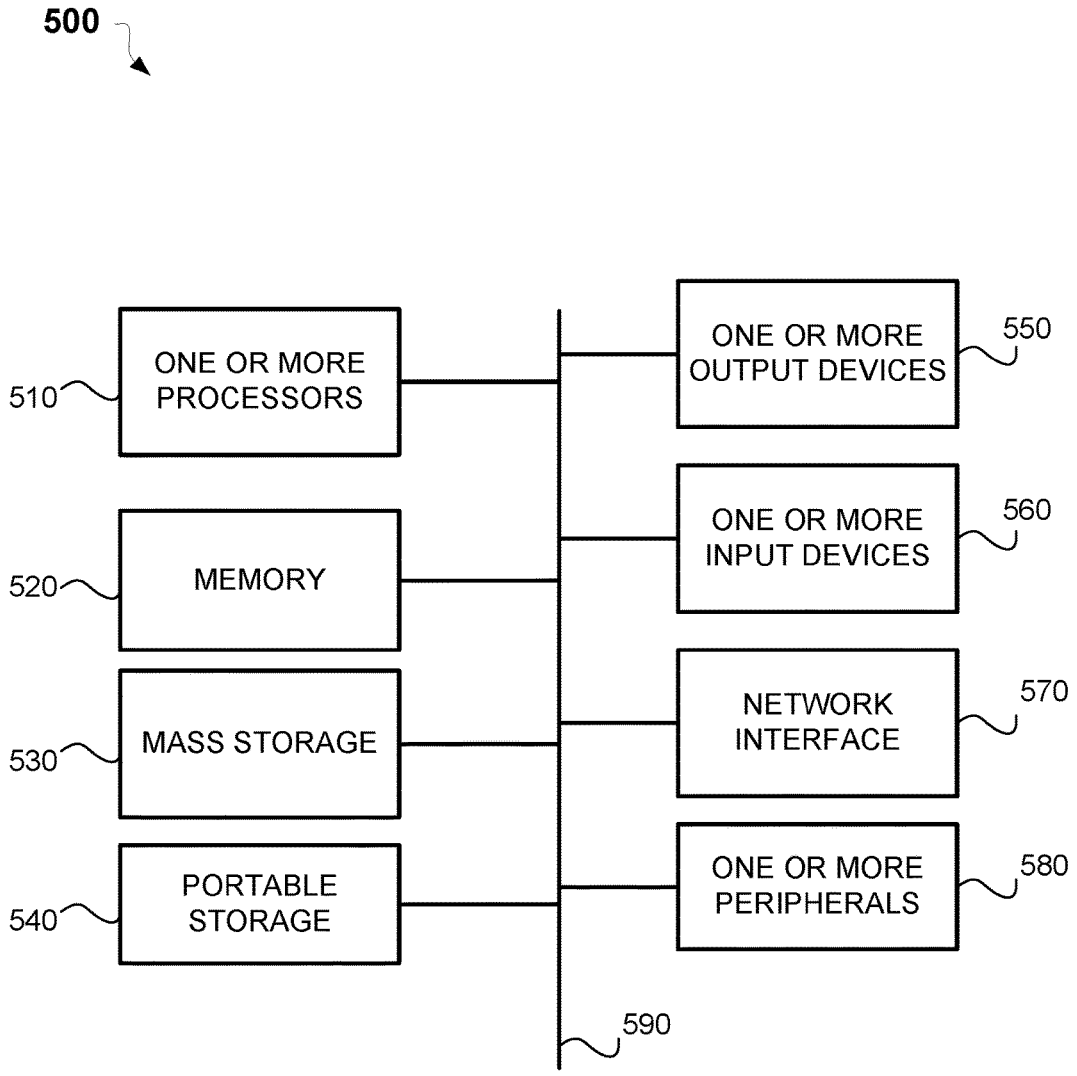
FIG. 5 is a computer system that may be used to implement the methods for operating a lock according to an example embodiment.

FIG. 5 is a block diagram illustrating an example computer system 500 suitable for implementing the methods described herein. In particular, computer system 500 may be an instance of mobile device 110 or server 115. FIG. 5 illustrates just one example of computer system 500 and in some embodiments, computer system 500 may have fewer elements than shown in FIG. 5 or more elements than shown in FIG. 5.

Computer system 500 includes one or more processors 510, a memory 520, one or more storage devices 530, one or more input devices 550, one or more output devices 560, network interface 570, and one or more peripherals 580. Processors 510 are, in some examples, configured to implement functionality and/or process instructions for execution within computer system 500. For example, processors 510 may process instructions stored in memory 520 and/or instructions stored on storage devices 530. Such instructions may include components of an operating system or software applications.

Memory 520, according to one example, is configured to store information within computer system 500 during operation. Memory 520, in some example embodiments, may refer to a non-transitory computer-readable storage medium or a computer-readable storage device. In some examples, memory 520 is a temporary memory, meaning that a primary purpose of memory 520 may not be long-term storage. Memory 520 may also refer to a volatile memory, meaning that memory 520 does not maintain stored contents when memory 520 is not receiving power. Examples of volatile memories include random access memories (RAM), dynamic random access memories (DRAM), static random access memories (SRAM), and other forms of volatile memories known in the art. In some examples, memory 520 is used to store program instructions for execution by the processors 510. Memory 520, in one example, is used by software. Generally, software refers to software applications suitable for implementing at least some operations of the methods as described herein.

Storage devices 530 can also include one or more transitory or non-transitory computer-readable storage media and/or computer-readable storage devices. In some embodiments, storage devices 530 may be configured to store greater amounts of information than memory 520. Storage devices 530 may further be configured for long-term storage of information. In some examples, the storage devices 530 include non-volatile storage elements. Examples of such non-volatile storage elements include magnetic hard discs, optical discs, solid-state discs, flash memories, forms of electrically programmable memories (EPROM) or electrically erasable and programmable memories, and other forms of non-volatile memories known in the art.

Still referencing to FIG. 5, computer system 500 may also include one or more input devices 510. Input devices 510 may be configured to receive input from a user through tactile, audio, video, or biometric channels. Examples of input devices 510 may include a keyboard, keypad, mouse, trackball, touchscreen, touchpad, microphone, one or more video cameras, image sensors, fingerprint sensors, or any other device capable of detecting an input from a user or other source, and relaying the input to computer system 500 or components thereof. Additional examples of input devices 510 include depth sensors, remote sensors, and so forth.

Output devices 210, in some examples, may be configured to provide output to a user through visual or auditory channels. Output devices 210 may include a video graphics adapter card, a liquid crystal display (LCD) monitor, a light emitting diode (LED) monitor, an organic LED monitor, a sound card, a speaker, a lighting device, a LED, a projector, or any other device capable of generating output that may be intelligible to a user. Output devices 210 may also include a touchscreen, presence-sensitive display, or other input/output capable displays known in the art.

Computer system 500, in some example embodiments, also includes network interface 570. Network interface 570 can be utilized to communicate with external devices via one or more networks such as one or more wired, wireless, or optical networks including, for example, the Internet, intranet, local area network (LAN), wide area network (WAN), cellular phone networks (e.g. Global System for Mobile (GSM) communications network, packet switching communications network, circuit switching communications network), Bluetooth radio, and an IEEE 802.11-based radio frequency network, among others. Network interface 570 may be a network interface card, such as an Ethernet card, an optical transceiver, a radio frequency transceiver, or any other type of device that can send and receive information. Other examples of such network interfaces may include Bluetooth, 3G, 4G, LTE, and Wi-Fi radios in mobile computing devices.

Operating system of computer system 510 may control one or more functionalities of computer system 510 or components thereof. For example, the operating system of computer system 510 may interact with software applications of computer system 510 and may facilitate one or more interactions between the software applications and one or more of processors 510, memory 520, storage devices 530, input devices 510, and output devices 210. Operating system of computer system 510 may interact with the software applications and components thereof. In some embodiments, the software applications may be included in the operating system of computer system 510. In these and other examples, virtual modules, firmware, or software of the software applications. In other examples, virtual modules, firmware, or software may be implemented externally to computer system 510, such as at a network location. In some such instances, computer system 510 may use network interface 570 to access and implement functionalities provided by virtual modules, firmware, or software for vehicle identification through methods commonly known as "cloud computing."

Thus, methods and systems for operating door locks using mobile devices have been described. Although embodiments have been described with reference to specific example embodiments, it will be evident that various modifications and changes can be made to these example embodiments without departing from the broader spirit and scope of the present application. Accordingly, the specification and drawings are to be regarded in an illustrative rather than a restrictive sense.

What is claimed is:

1. A method for operating a lock, the method comprising: wirelessly communicating, by a mobile device of a user, with a lock when the mobile device is within a predetermined distance from the lock;

receiving, by the mobile device, a first encrypted message from the lock, the first encrypted message being generated by the lock based on a first dynamic variable, the first dynamic variable being generated using a predetermined deterministic algorithm, the first dynamic variable being encrypted by the lock using a first key, the lock storing the first key and a second key, wherein the first key differs from the second key;

sending, by the mobile device, the first encrypted message supplemented with user credential data and a lock instruction to a server;

receiving, by the mobile device, a second encrypted message from the server after sending the first encrypted message to the server, the second encrypted message being generated by the server based on a second dynamic variable, the second dynamic variable being generated using the predetermined deterministic algorithm used to generate the first dynamic variable, wherein the second encrypted message is generated by the sever by decrypting the first encrypted message with the first key to extract the first dynamic variable, generating the second dynamic variable by encrypting the first dynamic variable with the second key, and generating the second encrypted message that includes the second dynamic variable, the server storing the first key and the second;

wirelessly transmitting, by the mobile device, the second encrypted message to the lock to cause the lock to perform a locking operation or an unlocking operation based on the lock instruction of the user.

2. The method of claim 1, wherein the first encrypted message is generated by the lock by acquiring the first dynamic variable and encrypting the first dynamic variable with a first key.

3. The method of claim 2, wherein the first encrypted message includes at least a header, a first signature, and an identifier of the lock, wherein the first signature includes the first dynamic variable encrypted with the first key.

4. The method of claim 3, wherein the lock stores the first key and a second key, wherein the first key is of 256-bit length and the second key is of the 256-bit length.

5. The method of claim 3, wherein the second encrypted message includes at least the header, a second signature, and the identifier of the lock, wherein the second signature includes the second dynamic variable encrypted with a second key, wherein the first dynamic variable is the same as the second dynamic variable.

6. The method of claim 5, wherein the lock is caused to perform the locking operation or the unlocking operation by obtaining the second encrypted message from the mobile device, decrypting the second encrypted message using the second key, extracting the second dynamic variable, and determining that the second dynamic variable matches the first dynamic variable.

7. The method of claim 6, wherein the first dynamic variable is generated by a clock of the lock.

8. The method of claim 6, wherein the lock is configured to generate the first dynamic variable using a deterministic algorithm.

9. The method of claim 6, wherein the lock is configured to generate the first dynamic variable in response to a wireless communication received from the mobile device and temporarily store the first dynamic variable in a memory of the lock until the lock performs a locking operation or an unlocking operation.

10. A lock for locking and unlocking a door, the lock comprising: an electromechanical locking module;

a communication module configured to wirelessly communicate with a mobile device when the mobile device is within a predetermined distance from the lock;

a memory storing a first key and a second key, wherein the first key differs from the second key, wherein the mobile device does not store the first key nor the second key; and a processor configured to:

generate a first dynamic variable using a predetermined deterministic algorithm;

generate a first encrypted message based on the first dynamic variable, the first dynamic variable being encrypted using the first key;

emit the first encrypted message;

receive a second encrypted message from the mobile device after sending the first encrypted message, wherein the second encrypted message is generated by a sever by decrypting the first encrypted message with the first key to extract the first dynamic variable, generating a second dynamic variable by encrypting the first dynamic variable with the second key, and generating the second encrypted message that includes the second dynamic variable, the server storing the first key and the second key;

decrypt the second encrypted message using the second key to retrieve the second dynamic variable, the second dynamic variable being generated using the predetermined deterministic algorithm used to generate the first dynamic variable;

verify that the second dynamic variable retrieved from the second encrypted message is an acceptable dynamic variable; and based on verification, cause the electromechanical locking module to perform a locking operation or an unlocking operation.

11. The lock of claim 10, wherein the processor is further configured to store the first dynamic variable in the memory, and wherein the verifying that the second dynamic variable retrieved from the second encrypted message is the acceptable dynamic variable includes matching the second dynamic variable to the first dynamic variable.

12. The lock of claim 10, wherein the first encrypted message includes at least a header, a first signature, and an identifier of the lock, wherein the first signature includes the first dynamic variable encrypted with the first key.

13. The lock of claim 12, wherein the second encrypted message includes at least a second signature, wherein the second signature includes the second dynamic variable encrypted with the second key.

14. The lock of claim 13, wherein the mobile device is not configured to decrypt the first signature nor the first signature.

15. The lock of claim 10, wherein the communication module is configured to wirelessly communicate with the mobile device only, the communication module is not configured to communicate with the server, and wherein the wireless communication of the communication module is based on Near Field Communication (NFC) protocols or Bluetooth protocols.

16. The lock of claim 10, wherein the first dynamic variable is generated using the predetermined deterministic algorithm with non-repeating values.

17. The lock of claim 10, wherein the first dynamic variable is generated by a clock.

18. A system for operating a door lock, the system comprising:

a server; and a lock, the lock comprising:

an electromechanical locking module;

a communication module configured to wirelessly communicate with a mobile device when the mobile device is within a predetermined distance from the lock;

a memory storing a first key and a second key, wherein the first key differs from the second key, wherein the mobile device does not store the first key nor the second key; and a processor configured to:

generate a first dynamic variable using a predetermined deterministic algorithm;

generate a first encrypted message based on the first dynamic variable, the first dynamic variable being encrypted using the first key;

emit the first encrypted message;

receive a second encrypted message from the mobile device after sending the first encrypted message;

decrypt the second encrypted message using the second key to retrieve a second dynamic variable, the second dynamic variable being generated using the predetermined deterministic algorithm used to generate the first dynamic variable;

verify that the second dynamic variable retrieved from the second encrypted message is an acceptable dynamic variable; and based on verification, cause the electromechanical locking module to perform a locking operation or an unlocking operation;

wherein the server is configured to:

receive the first encrypted message from the mobile device;

decrypt the first encrypted message with the first key to extract the first dynamic variable;

generate the second dynamic variable by encrypting the first dynamic variable with the second key, the server storing the first key and the second key;

generate the second encrypted message that includes the second dynamic variable, wherein the first dynamic variable matches the second dynamic variable; and send the second encrypted message to the mobile device in response to receiving the first encrypted message.

* * * * *